United States Patent [19]

Young

[11] Patent Number: 4,704,757

[45] Date of Patent: Nov. 10, 1987

[54] ABRADING MATERIAL

[76] Inventor: David C. Young, 17 Barbers Wood Close, Ravenshead, Nottinghamshire, England

[21] Appl. No.: 719,805

[22] Filed: Apr. 4, 1985

[30] Foreign Application Priority Data

Apr. 5, 1984 [GB] United Kingdom ..... 8408838

[51] Int. Cl.[4] ..... B08B 1/00

[52] U.S. Cl. ..... 15/104.94; 15/244 B; 66/191; 428/253

[58] Field of Search ..... 428/253; 66/191; 28/159; 15/104.93, 104.94, 244 B

[56] References Cited

U.S. PATENT DOCUMENTS

| | | | |
|---|---|---|---|
| 1,573,788 | 2/1926 | Wiese | 66/191 |
| 2,124,361 | 7/1938 | Fleisher | 66/191 |
| 2,279,919 | 4/1942 | Fleisher | 66/191 |
| 2,528,183 | 10/1950 | Schmidt | 66/191 |
| 2,703,774 | 3/1955 | Morrison | 28/159 |
| 4,287,633 | 9/1981 | Gropper | 15/244 B |
| 4,298,643 | 11/1981 | Miyagara et al. | 428/253 |

*Primary Examiner*—James J. Bell

*Attorney, Agent, or Firm*—Charles E. Brown; Charles A. Brown

[57] ABSTRACT

Abrasive sheet material knitted from at least two or more yarns at least one of which is a shrinkable yarn and provides a knitted ground structure, loops of a non-shrinkable yarn being secured to the knitted ground structure so that upon shrinking of the shrinkable yarn or yarns, loops of the non-shrinkable yarn upstand from the surface of the ground structure.

4 Claims, 3 Drawing Figures

ABRADING MATERIAL

The present invention relates to abrading material for use in, for example, the manufacture of scouring pads.

One known method of producing a scouring pad has been to enclose a sponge of plastics material impregnated with a detergent in a cover knitted from a material having good abrasive characteristics, such as yarn made by cutting a synthetic film of a polyester, for example that known under the Registered Trade Mark "Mylar".

Among the objects of the present invention is to provide an abrasive, knitted material more effective for the purpose described in that the surface presented to the work is made up of projecting loops of the abrasive material.

According to one aspect of the present invention there is provided a method of making an abrading sheet material which comprises knitting a ground structure of a shrinkable material or materials, with laid-in floated threads of a second material which is harder than and either non-shrinkable or less shrinkable than the ground structure material and shrinking the ground structure so that loops of the second material are raised from the surface thereof.

According to another aspect of the present invention there is provided an abrasive sheet material comprising a knitted ground structure of a shrinkable material or materials having laid in floated threads of a second material which is harder than and either non-shrinkable or less shrinkable than the ground structure material, the ground structure being shrunk so that loops of the second material extend from the surface thereof.

When the sheet of the present invention is used to provide the cover of a scouring pad, enclosing a resilient core e.g. a plastics foam, which may be impregnated with a detergent, the said surface of the sheet from which the loops of the second material are raised or from which they extend forming the external surface of the pad so that in use of the pad substantially only the second material makes contact with the work top be scoured, the shrunken ground structure serving mainly as an anchor for the loops and as an enclosure for the core permeable by the detergent.

The first material from which the ground structure is knitted in preferably a heat shrinkable plastics material such as PVC. The second, abrasive material is preferably in the form of a yarn made by cutting a synthetic polyester film such as that known under the Registered Trade Mark "Mylar". It will be appreciated however that any other abrasive tape or yarn may be utilised.

A preferred embodiment of the present invention will now be described with reference to the accompanying, diagrammetic drawings, in which.

Figure 1:
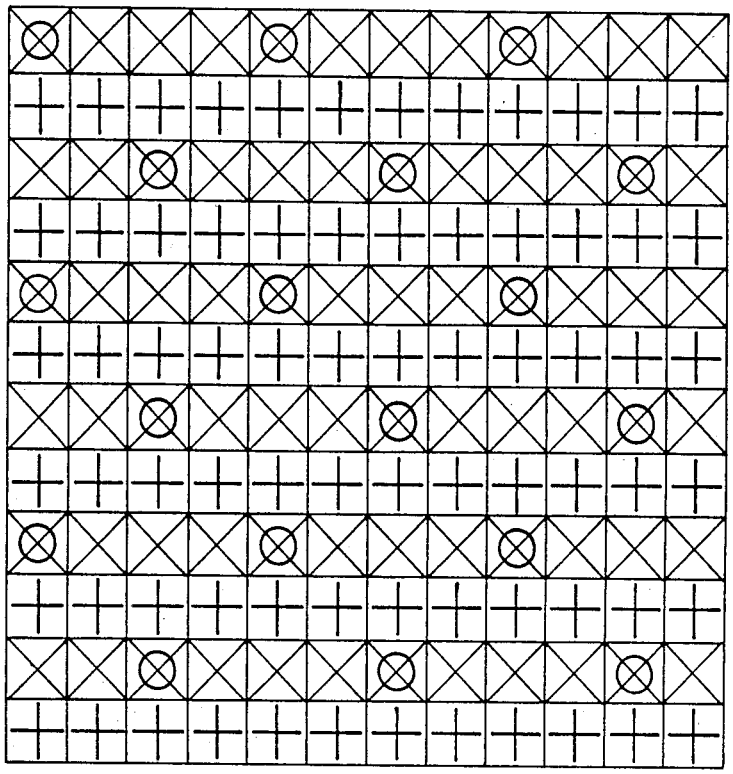
FIG. 1 is a pattern illustrating how material in according with the invention is knitted.

A ground structure of a mixture of PVC yarn and polyester yarn is knitted according to the pattern of FIG. 1 in which the "x" lines indicate courses of PVC yarn and the "+" lines indicate knitted courses of polyester yarn. During knitting "Mylar" yarn in the form of a tape is laid in, being tucked to each fourth stitch of PVC yarn across the courses, the tucks O of alternative threads of "Mylar" having a walewise staggered relationship so that the floated loops of "Mylar" are not in alignment in the direction of the wales of the fabric.

Figure 2:
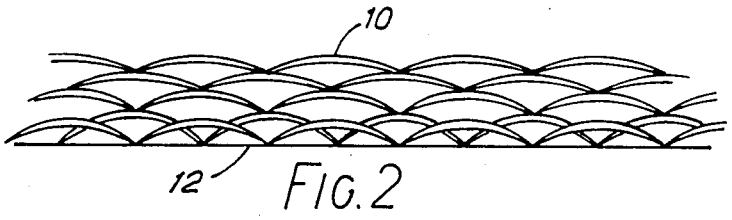
FIG. 2 is a perspective view illustrating the top surface of the material before the ground structure is shrunk.
Figure 3:
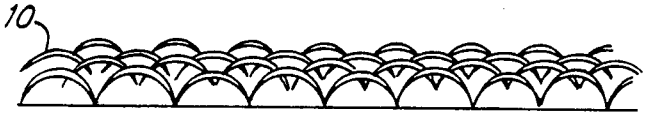
FIG. 3 is a view similar to FIG. 2 showing the projection of the laid in yarn after the ground structure has been shrunk.

FIG. 2 diagrammatically illustrates the top surface of the fabric after it has been knitted. It will be seen that the floated loops 10 of "Mylar" lie close to the ground structure 12. The fabric is now subjected to controlled shrinkage and heat setting so that the PVC yarn shrinks but the "Mylar" yarn does not. The effect of this is that the tucks O move together and cause the floted loops 10 to stand up from the top surface of the fabric as diagrammatically shown in FIG. 3.

One use of the thus made fabric is as the cover of a scouring pad (not shown). A suitably sized piece of the fabric is folded round a core e.g. of foam plastics with the top surface from which the loops 10 extend on the outside. Where edges of the fabric meet all round the core, they are sealed in any suitable way such as sewing or welding.

A scouring pad produced in this way has superior characteristics in that each floated loop of "Mylar" presents to the work a hoop with sharp lateral edges which projects from the pad. It is considered that such a hoop will have a better scouring action while being less deformable than e.g. a fibre and will have adequate strength without a tendency to inflict damage.

I claim:

1. An abrasive sheet material comprising a knitted ground structure formed of a heat shrinkable first material, said knitted ground structure having laid in floated threads of a second material in the form of projecting loops, said second material being harder than said first material and being less shrinkable than said ground structure material, said ground structure being shrunk from its as knitted state with said loops of said second material extending from the surface of said knitted ground structure in the form of abrading elements, and with said abrasive sheet material being folded to enclose a resilient core and defining a scouring pad, the surface of said sheet material from which said loops of said second material are raised forming an external surface of said scouring pad whereby in use of said scouring pad substantially only said second material makes contact with the work to be scoured with said shrunken ground structure serving as an anchor for said loops and as an enclosure for said resilient core.

2. An abrasive sheet material folded into a scouring pad according to claim 1 in which said resilient core is impregnated with a detergent.

3. An abrasive sheet material comprising a knitted ground structure formed of a heat shrinkable first material, said knitted ground structure having laid in floated threads of a second material in the form of a projecting loops, said second material being harder than said first material and being less shrinkable than said ground structure material, said ground structure being shrunk from its as knitted state with said loops of said second material extending from the surface of said knitted ground structure in the form of abrading elements, and in which said knitted ground structure comprises alternate courses of PVC yarn and polyester yarn with loops of said second material being tucked to tuck stitches which are each the fourth stitch of each course of said PVC yarn.

4. An abrasive sheet material comprising a knitted ground structure formed of a heat shrinkable first material, said knitted ground structure having laid in floated threads of a second material in the form of projecting loops, said second material being harder than said first material and being less shrinkable than said ground structure material, said ground structure being shrunk from its as knitted state with said loops of said second material extending from the surface of said knitted ground structure in the form of abrading elements, and in which said tuck stitches are staggered walewise one relative to the other.

* * * * *